United States Patent [19]

Lantz

[11] Patent Number: 4,624,575

[45] Date of Patent: Nov. 25, 1986

[54] CEMENT MOBILE MIXER

[75] Inventor: Alpheus D. Lantz, Morgantown, Pa.

[73] Assignee: Lantz Construction Company, Morgantown, Pa.

[21] Appl. No.: 771,506

[22] Filed:. Aug. 30, 1985

[51] Int. Cl.[4] ..... B28C 7/04

[52] U.S. Cl. ..... 366/16; 366/20; 366/34; 366/35; 366/38; 366/40; 366/50

[58] Field of Search ..... 366/16, 17, 19, 20, 366/21, 27, 28, 34, 35, 36, 40, 50, 51, 38, 40, 151, 152, 160

[56] References Cited

U.S. PATENT DOCUMENTS

| | | | |
|---|---|---|---|
| 1,814,483 | 7/1931 | Morgan . | |
| 2,947,544 | 8/1960 | Hurt | 275/8 |
| 3,289,888 | 12/1966 | Ohman | 222/43 |
| 3,295,698 | 1/1967 | Ross | 366/19 |
| 3,310,293 | 3/1967 | Zimmerman | 259/148 |
| 3,380,717 | 4/1968 | Adams et al. | 259/154 |
| 3,456,925 | 7/1969 | Gallagher | 259/161 |
| 3,623,708 | 11/1971 | Futty | 259/164 |
| 3,719,214 | 3/1973 | Erndt | 141/51 |
| 3,746,313 | 7/1973 | Weeks | 366/19 |
| 3,820,914 | 6/1974 | Zimmerman | 404/110 |
| 3,998,436 | 12/1976 | Allen et al. | 259/154 |
| 4,071,226 | 1/1978 | Miller | 366/64 |
| 4,072,435 | 2/1978 | Coho et al. | 404/110 |
| 4,219,279 | 8/1980 | Haws | 366/35 |
| 4,298,288 | 11/1981 | Weisbrod | 366/8 |
| 4,406,548 | 9/1983 | Haws | 366/8 |
| 4,427,297 | 1/1984 | Stastny | 366/19 |
| 4,436,431 | 3/1984 | Strong | 366/17 |

OTHER PUBLICATIONS

Cemen-Tech "Concrete Dispenser" flyer, printed 1983.

Daffin Mobile Products flyer—"A New Generation of Concrete-Mobile Units", p. D-100, copyright 1979.

Elkin Hi-Tech Mobile Concrete Mixer flyer, copyright 1983.

Zimmerman, Inc. "Zim-Mixer" flyer, copyright 1984.

*Primary Examiner*—Robert W. Jenkins

*Attorney, Agent, or Firm*—Thomas Hooker

[57] ABSTRACT

A cement mobile mixer for mixing concrete from sand, aggregate, cement and water.

10 Claims, 11 Drawing Figures

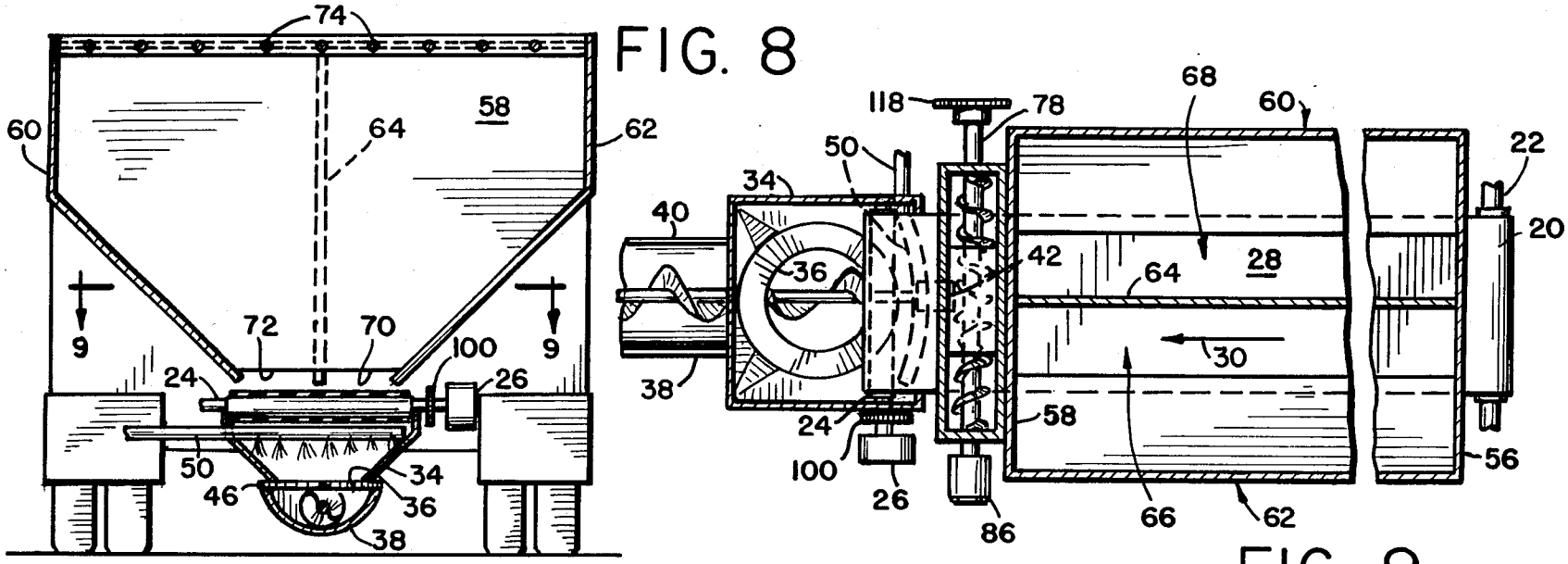
FIG. 8
FIG. 9
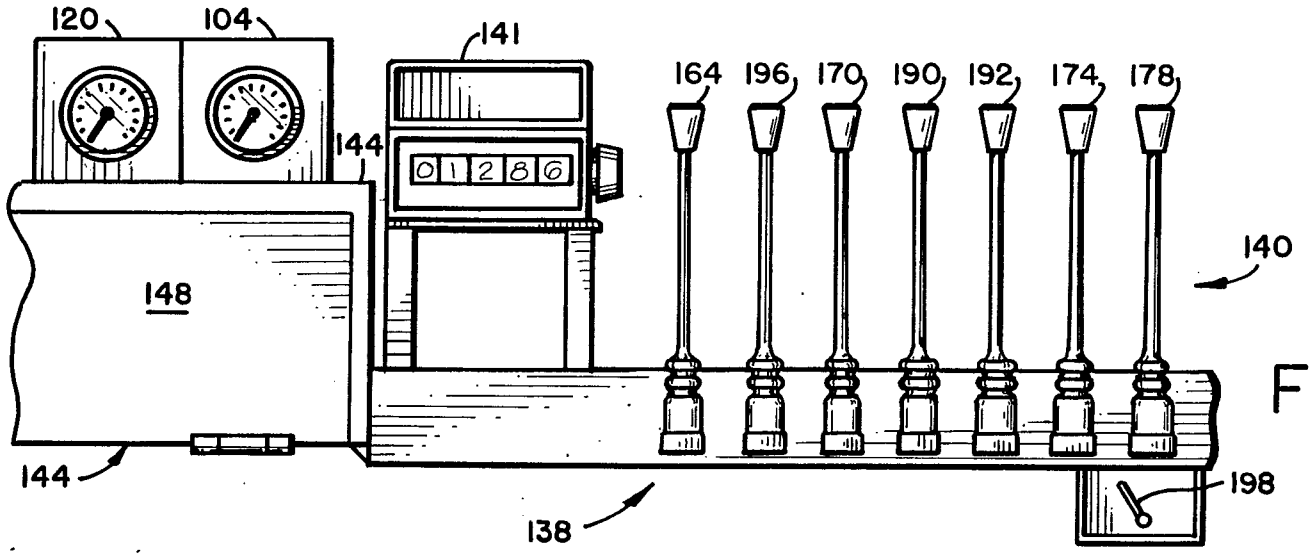
FIG. 10

CEMENT MOBILE MIXER

This invention relates to a cement mobile mixer for mixing concrete from sand, aggregate, cement and water. Typically, the mixer is mounted on the bed of a truck for ease of movement to a job site for on-site mixing of concrete meeting customer requirements. Cement mobile mixers are shown in U.S. Pat. Nos. 3,456,925 and 4,406,548.

Conventional cement mobile mixers include sand, aggregate and cement bins and a belt or rope chain for delivery of sand and aggregate to a chamber where the ingredients fall into a auger trough for mixing and subsequent delivery as concrete. Water is delivered to the trough. While these mixers provide controls for providing different types of concrete mixes, the control adjustments are mechanical and incremental in nature and are hard to use. The controls are not independently or continuously adjustable. During mixing it is difficult or impossible to determine whether the ingredients are supplied to the mixing trough in proper proportion for the required mix. This lack of control over the mixing operation may result in the concrete being either too strong or too weak. In some mixers, inadequate cement may be delivered due to the design of the cement delivery device where the powdered cement hangs up in individual delivery compartments and does not fall into the mixing trough.

The cement mobile mixer of the present invention uses an improved hydraulic control system which enables the operator to adjust the amounts of aggregate and sand mix, cement and water delivered to the trough individually. The rate of delivery is visually indicated and adjustments to the rates of delivery may be made during mixing to enable the operator to assure the concrete meets the job requirements. The rates of delivery are continuously adjustable.

The mixer uses hydraulic motors to deliver the ingredients and control valves with the valves being located at or adjacent to the control station for convenience of the operator. This facilitates the ease of start up, adjustment and production control of the mixer. Calibrating tachometers measure the rates at which the sand and aggregate mix and cement are delivered to the mixing trough, thereby providing an on-job indication of the quality of the concrete. The rate at which water is delivered to the mixing trough is also monitored. Visual inspection of the concrete as mixed enables the operator to adjust the rate at which water is flowed into the mixing trough so that the concrete has proper slump characteristics.

The valves of the hydraulic system used to operate the cement mobile mixer are located in a cabinet on one side of the mixer in front of the control station and readily available to the operator. When the mixer is not in operation, the cabinet is closed, thereby protecting the control system from accidental damage. The control levers for the main control valves are located behind the cabinets at the control station. The tachometers are mounted on the cabinets near the control station. The levers are connected to the actual valves by actuating cables, thereby permitting the operator to shift the valves from the control station while exercising needed visual monitoring of the tachometer and mixing and discharge operations.

The cement mobile mixer includes a water tank from which water is drawn for delivery to the mixing chute.

An exhaust pipe loop in the tank may be connected to the truck exhaust pipe so that during cold weather operation the exhaust gasses are flowed through the tank to preheat the water and facilitate curing of the concrete.

The invention is primarily directed to the cement mobile mixer useful in mixing concrete at a job site. It is also intended that the invention be used for dry mixing such as the preparation of greenhouse soil mixes or dry concrete mix. In this case, mixing is performed and controlled as described with the exception that water is not be supplied to the mix. The mix is either bagged or discharged into a storage container. The mixer assures that the dry ingredients are in proper proportion and that they are uniformly mixed together.

In some cases the mixer may be mounted on a skid with a power motor on the skid rather than on a truck. Movement would then be by dragging the skid or, in the case of a long distance move, by placing the skid and mixer on a truck for transport.

Other objects and features of the invention will become apparent as the description proceeds, especially when taken in conjunction with the accompanying drawings illustrating the invention, of which there are four sheets and one embodiment.

IN THE DRAWINGS

Figure 1:
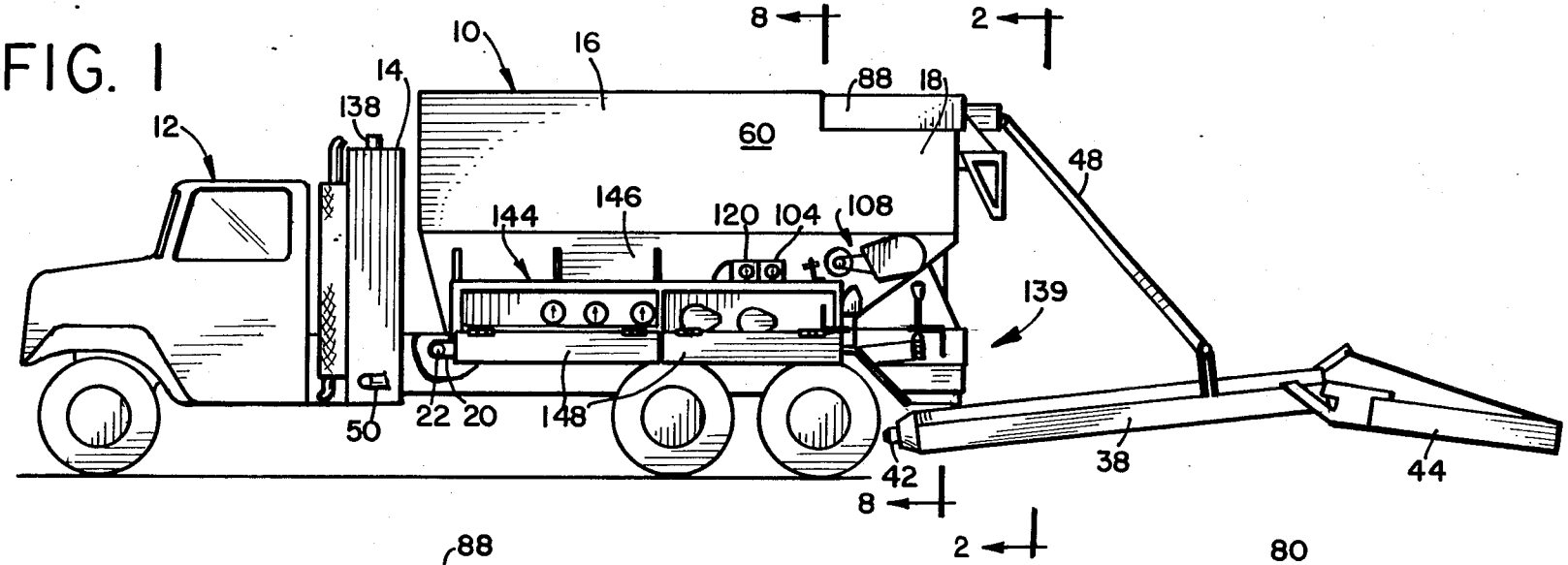
FIG. 1 is a side view of a cement mobile mixer according to my invention mounted on a truck.
Figure 2:
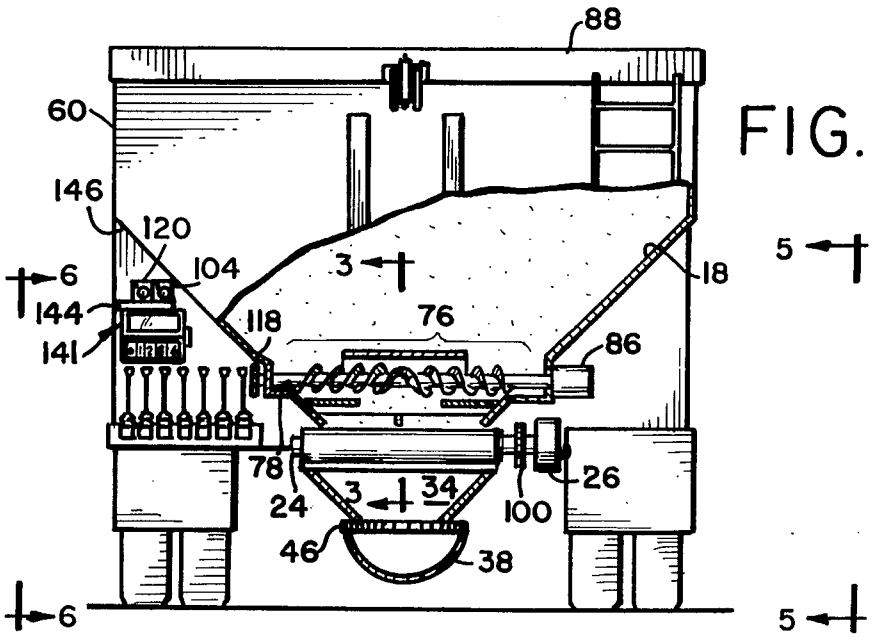
FIG. 2 is a partially broken away view taken generally along line 2—2 of FIG. 1.
Figure 5:
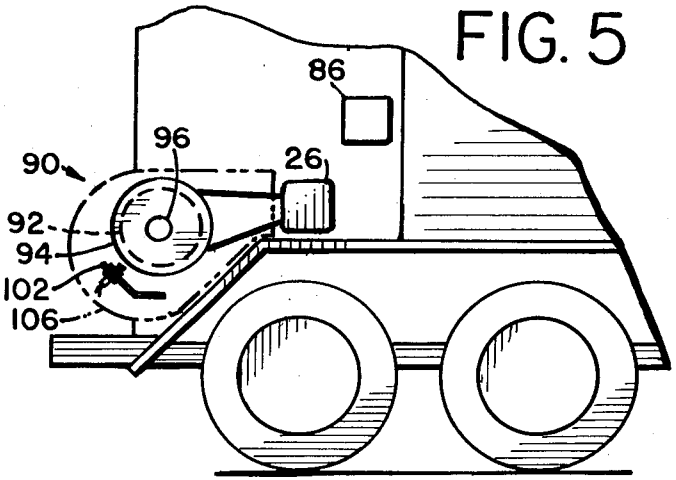
Figure 7:
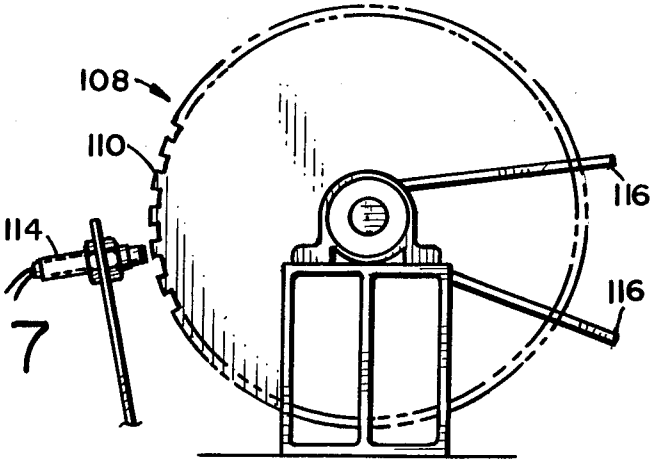
Figure 6:
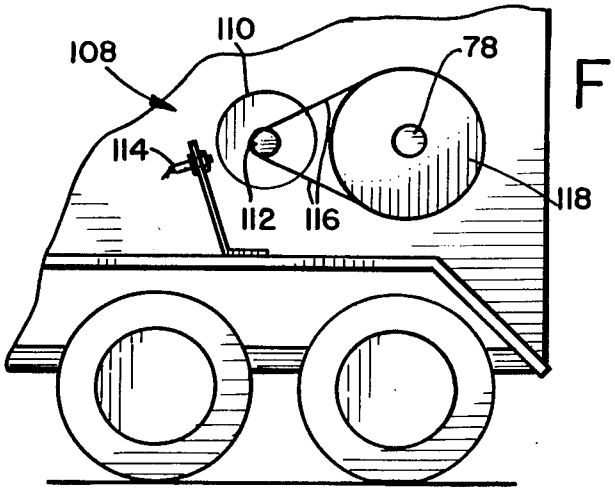
Figure 11:
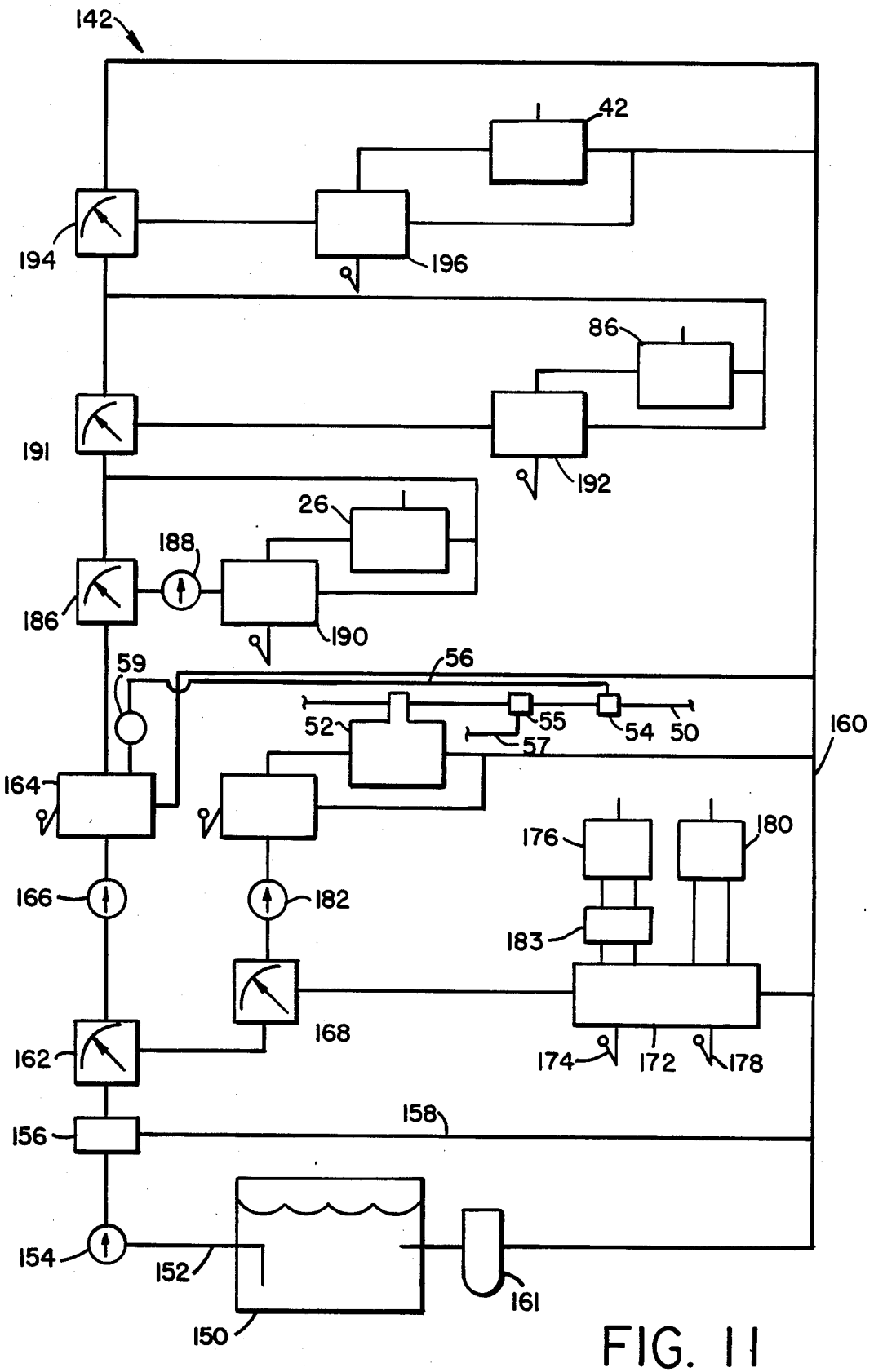

FIGS. 5 and 6 are views taken generally along lines 5—5 and 6—6 of FIG. 2;

FIG. 7 is an enlarged view of a portion of FIG. 6;

FIG. 8 is a view taken generally along line 8—8 of FIG. 1;

FIG. 9 is a view taken generally along line 9—9 of FIG. 8;

FIG. 10 is a generalized view illustrating controls at the work station of the cement mobile mixer; and FIG. 11 is a schematic view of the hydraulic and part of the electrical controls for the cement mobile mixer.

Figure 3:
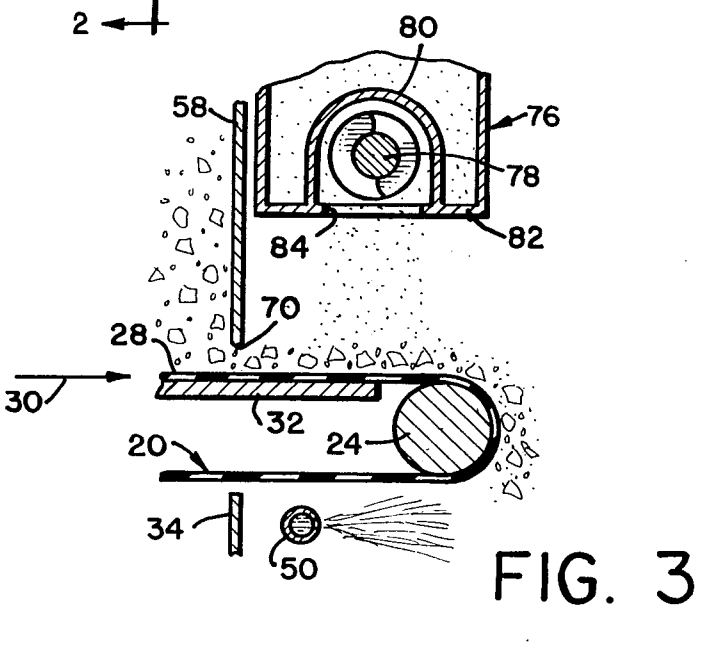
FIG. 3 is a sectional view taken along line 3—3 of FIG. 3.

The cement mobile mixer 10 is preferably mounted on the bed of heavy duty truck 12 and includes a water tank 14 located behind the cab of the truck, a combination sand and aggregate hopper 16 located rearwardly of the water tank and a cement hopper 18 located at the back of the mixer. A sand, aggregate and cement feed belt 20 is wrapped around pair of shafts 22 and 24 journalled in bearings on the mixer so that the upper run 28 of the belt extends from the forward end of the hopper rearwardly past the bottom of the cement hopper 18. A fluid motor 26 on the mixer 10 rotates shaft 24 such that actuation of the motor rotates the shaft to move the upper run 28 of belt 20 downstream in the direction of arrow 30 shown in FIGS. 3 and 9. The upper run of the belt is suitably supported by plate 32 shown in FIG. 3. A continuous webbed chain may be used in place of belt 20 for delivery of the sand and aggregate from hopper 16. A webbed chain is wrapped around shafts 22 and 24 as with belts 20 with the upper run of the webbed chain supported by plate 32 and moved in the downstream direction by suitable engagement between the chain and shaft 24. Because the webbed chain is equivalent to the described belt 20, it is intended that reference to belt 20 also include reference to a webbed chain.

Belt 20 delivers sand, aggregate and cement into a discharge chamber 34 surrounding the downstream end of the belt and having a lower opening 36 above one end of mixing through 38 extending rearwardly from the truck. A mixing auger 40 driven by fluid motor 42 extends along the interior of trough 38. When rotated by the motor the auger mixes the sand, aggregate, cement and water which fall through opening 36 and conveys the mixed concrete along the trough, and any extension such as trough 44 shown in FIG. 1, to a desired discharge location. Trough 38 is pivotedly mounted on the bottom of the chamber 34 and may be moved to the right or left relative to the chamber by actuation of a fluid motor (not illustrated in FIG. 1 through 9) by means of a chain between the motor and gear 46 on the trough at opening 36. The trough 38 may be raised or lowered relative to the discharge chamber by actuation of a hydraulic motor (not illustrated in FIGS. 1 through 9) to shorten or lengthen the trough hoist cable 48 running from the top of the cement hopper 18 to trough 38 outwardly of the discharge chamber.

Mixing water is supplied to the discharge chamber by water delivery pipe 50 which extends into the chamber from one side and then across the chamber beneath the downstream end of the feed belt 20. A number of delivery openings are provided in the pipe 50 within the chamber so that during operation of the cement mobile mixer appropriate water is flowed into trough 38 to provide concrete having desired slump properties. Pipe 50 extends from the discharge chamber to water tank 14. A hydrulic pump 52 is provided in pipe 50 to flow water from the tank to the discharge chamber at a controlled rate. An electrically actuated shut-off valve 54 in pipe 50 downstream of the pump 52 stops the flow of water to the chamber independent of operation of the pump. When pump 52 is actuated and valve 54 is closed pressure relief valve 55 in pipe 50 returns pumped water back to tank 14 through pipe 57. The valve 54 is controlled by main lever valve 164 shown in FIG. 10. When valve 164 is closed valve 54 prevents flow through pipe 50. Opening of valve 164 shifts valve 54 to open pipe 50 and, in the event pump 52 is actuated, flow water to the chamber 34. A manually actuated override switch 59 enables the mixer operator to open valve 54 when valve 164 is closed. Switch 59 is located at the control station.

The sand and aggregate hopper 16 includes front and rear walls 56 and 58 and side walls 60 and 62 as shown in FIG. 9. The lower portions of side walls 60 and 62 slope inwardly and overlap the edges of belt 20. A vertical partition 64 extends between the front and rear walls 56 and 58 to define a aggregate bin 66 on one side of the hopper and a sand bin 68 on the other side of the hopper. As shown in FIG. 9, the belt 20 extends to either side of the partition 64 and forms the bottom of both bins 66 and 68. The bottom of rear wall 58 is spaced a distance above the belt 20 to provide an aggregate discharge slot 70 and a sand discharge slot 72 between the belt and the bottom of the plate as shown in FIG. 8. The partition 64 is located slightly nearer to side wall 60 than sidewall 62 so that the aggregate discharge slot 70 is greater in cross sectional area than the sand discharge slot 72, and the total mix carried through the slots by the belt is 55% aggregate and 45% sand. This mix of sand and aggregate is desired for making high-strength concrete. A rectangular rod grid 74 is provided over the tops of both the sand and aggregate bins 66 and 68 to assure breakup of clumps of sand and aggregate as they are dumped into the bins. If desired, a tarpaulin or other cover may be spread over the tops of the bins to keep the contents dry.

The cement hopper includes front, back and side walls located rearwardly of the sand and aggregate hopper. The lower ends of the side and back walls slope inwardly to define a relatively narrow hopper bottom 76 located a slight distance above the downstream end of belt 20 behind the rear wall 58 of the sand and aggregate hopper. See FIG. 3. A reverse-flighted ribbon auger 78 extends across the hopper bottom 76 and under a U-shaped shield 80 which is joined to the bottom plate 82 above central cement discharge opening 84 in the plate. This opening is located above the belt 20. The auger 78 is suitably journalled in bearings on the side walls of the cement hopper and is rotated by a fluid motor 86 in a direction so that cement in the hopper is reliably drawn inwardly from both ends of bottom 76, under the shield 80 and discharged through opening 84 onto the upper run of belt 20. The discharged cement falls on the sand and aggregate carried by the belt and is discharged with the sand and aggregate into chamber 34. The auger 76 has a close fit with shield so that a known volume of cement is discharged through opening 84 with each revolution of the auger.

If desired, vibrators or an additional breakup auger may be provided in the upper portion of the cement hopper to assure that loose cement falls to the bottom of the hopper for controlled discharge as described. The cement hopper is provided with a removable cover 88.

The cement mobile mixer is provided with speed sensors for shaft 24 and auger 78 to enable the operator to control accurately the rate at which the sand and aggregate mix and cement are discharged into the chamber 34. The rotary speed of belt shaft 24 is monitored by sensor unit 90 shown in FIG. 5. The sensor unit includes a driven gear 82 and a tooth wheel 94 both on shaft 96 which is in turn rotatably mounted on the body of mixer 10. Chain 98 extends around drive gear 100 on shaft 24 (see FIG. 2) and gear 92 so that wheel 94 rotates with shaft 24. A detector 102 is mounted on the body of mixer 10 adjacent the outer circumference of wheel 104 and generates an output signal proportional to the rate at which the teeth of wheel 94 are rotated past the detector. The output signal from the detector drive tachometer 104 located on the left side of the mixer and facing the back of the mixer so that the operator is provided with a continuous visual indication of the rate at which the 55%–45% mix of aggregate and sand is delivered to discharge chamber 34 by belt 20. A guard cover 96 may be provided to protect sensor unit 90.

Sensor unit 108 for cement feed auger 78 is shown in FIGS. 6 and 7 includes a tooth wheel 110 like wheel 94 and a gear 112 both mounted on a shaft rotatably mounted on the body of mixer 10, together with a detector 114 like detector 102. A chain 116 joins gear 112 and large diameter gear 118 mounted on the end of auger 78 away from fluid motor 86. In this way, the wheel 110 is rotated past detector 114 in response to rotation of the auger and feed of cement from hopper 18 into the discharge chamber 34. The output of the detector 114 drives a second tachometer 120 like tachometer 104 located adjacent tachometer 104 and also visible to the operator of the cement mobile mixer.

Both sensor units 90 and 108 use like tooth wheels and detectors. During operation of mixer 10 shaft 24 rotates at a relatively high speed to move belt 20 past the aggregate and sand hopper for delivery of sand and aggregate to the mixing chamber at an appropriate rate. The driven gear 92 on sensor 90 has a larger diameter than driving gear 100 on shaft 24 so that wheel 94 rotates more slowly than the driven shaft 24. During operation of the mixer, the cement feed auger 78 rotates more slowly than shaft 24 so that the gear 118 on the auger shaft has a larger diameter than the driven gear 112 of sensor 108. The result of the step down chain drive is that the wheel 110 rotates past detector 114 at approximately the same circumferential speed as wheel 94 rotates past detector 102. This relationship is maintained by the step down chain drive for sensor 90 and the step up chain drive for sensor 108.

Figure 4:
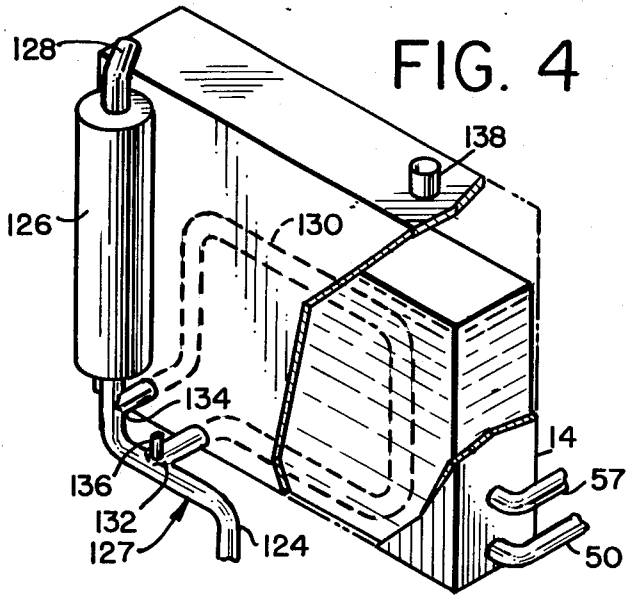
FIG. 4 is a partially broken away perspective view of a water supply tank shown in FIG. 1.

FIG. 4 illustrates water tank 14 and the exhaust system 122 for the motor of truck 12. The system includes an exhaust pipe 124 extending from the motor to a vertical muffler 126 having a tailpipe 128 above the top of the tank. An optional exhaust loop 130 is joined to pipe 124 at junction 132 and extends into and around the interior of the tank 14 and then rejoins the exhaust pipe 124 at junction 134 downstream from junction 132. An adjustable valve 136 is provided at junction 132 to flow exhaust gases directly through pipe 124 to muffler 126 and tailpipe 128 or, alternatively, to flow the exhaust gases from the pipe 124 through the loop 130 and back to the pipe and through the muffler and tailpipe. Tank 14 is provided with a filling and vent cap 138 at the top of the tank, an outlet to pipe 50 at the bottom of the tank and an inlet for pipe 57. Pipes 50 and 57 run rearwardly along the mixer 10.

The controls at the control station 139 located at the left rear of mixer 10 includes a series of seven levers indicated generally at 140 in FIG. 2 for hydraulic valves in the control system 142 and a conventional meter 14 which measures the volume of concrete delivered during a given job and punches this information on a customer ticket for billing purposes. The operator stands behind the levers 140 at station 139 in position to observe and control the mixing operation by appropriately actuating the valves in a manner to be described. The operator also observes the tachometers 104 and 120 to assure that the mixer 10 is delivering an appropriate mix of ingredients as required for the specified concrete.

FIG. 10 illustrates the hydraulic control system 142 of mixer 10. This system includes the valves controlled by the levers of series 140 and additional flow controls and gauges all of which are located in a pair of cabinets 144 on the left side of the mixer 10 immediately forward of the control station. The levers are connected to the valves by suitable cable actuators. Each valve and its lever actuator are identified by the same reference number. As shown in FIG. 1 the cabinets 144 are located within the width of the mixer under the lower inwardly sloping portion 146 of sand and aggregate hopper sidewall 60. The cabinets 144 open on the outside of the mixer and are provided with doors 148 hinged on the bottoms of cabinets so that when opened the doors hang down as illustrated in FIG. 1 to freely expose the hydraulic system components located within the cabinets. In this way, the mixer operator has immediate and free access to these components during set-up and operation of the mixer. Ready access of the hydraulic system components further facilitates maintenance and repair of the system as required. When closed, doors 148 protect the components within cabinets 144 from tampering or possible injury when the mixer is not in use. The tachometers 104 and 120 are mounted on top of cabinets 144 adjacent the levers 138 and within the recess under wall portion 146.

Control system 142 includes a hydraulic fluid reservoir 150, a high pressure pump 154, pressure relief valve 156 having a low pressure return line 158 connected to main return line 160 which flows low pressure hydraulic fluid back to the reservoir through suitable filter 116. The pump 154 is driven by the engine of truck 12. The high pressure output of pressure relief valve 156 is connected to manually adjustable flow control valve 162 having a high pressure output connected to main lever control valve 164. A pressure gauge 166 is located on the line between valves 162 and 164. The return of valve 162 is connected to a second manually adjustable control valve 168 having a high pressure output connected to water pump lever valve 170 with a return line connected to lever valve 172. Valve 172 includes a lever valve 174 for supplying hydraulic pressure fluid to the fluid motor 176 used to swing the trough 38 to the right and left and a lever control valve 178 which supplies hydraulic fluid to hydraulic motor 180 used to raise and lower trough 38 by shortening or lengthening cable 48. A safety pressure relief valve 183 is provided in the lines extending between valve 174 and hydraulic fluid motor 176 to deactivate the motor in the event the trough hits an obstacle while being swung. The return of valve 172 is connected to the main return line 160. A pressure gauge 182 is provided in the line between valves 168 and 170. Movement of lever valve 170 to the on position flows high pressure fluid to hydraulic water pump 52. The returns of the pump and of valve 170 are connected to the main return line 160.

The high pressure output of main lever valve 164 is connected to a third manually adjustable flow control valve on 186 and the return from the valve 164 is connected directly to the main control line 160. The high pressure output of valve 186 is connected to gauge 188 and to belt valve lever 190 having a high pressure output connected to hydraulic motor 26 which rotates shaft 24 for moving the belt 20 to move the upper run 28 under the sand and aggregate hopper and into chamber 34. The returns from valve 190 and hydraulic motor 26 are joined to the return line of valve 186 and are connected to manually adjustable flow control valve 191. The high pressure output of this valve is connected to cement flow lever valve 192, the high pressure output of which is connected to hydraulic motor 86 which rotates the cement auger 78. The returns from valve 192 and motor 86 are connected to a line connecting the return of valve 192 to manually adjustable flow control valve 194. The high pressure output of this valve is connected to the input of mixer lever valve 196, the output of which is directed to hydraulic auger mixer motor 42. The returns for valves 194 and 196 and motor 42 are connected to main return line 160.

The series of manual control valve levers 138 mounted at the control station 139 are shown in FIG. 10 and include, from left to right, levers for valves 164, 196, 170, 190, 192, 174 and 178. In addition to these valves, an accelerator control 198 for the engine of truck 12 is mounted on the mixer below the lever control valves for access by the operator. Accelerator 198 is used to speed up or slow down the truck engine in response to requirements of the mixer 10.

The operation of the cement mobile mixer 10 will now be described.

Truck 12 is driven to the job site and moved to a proper position for delivering concrete. The operator then disengages the transmission and engages the truck engine to pump 154 so that the engine and pump may be accelerated to operating speed by use of accelerator 198. Cabinets 144 are opened to provide access to gauges 166, 182 and 188 and to control valves 168, 186, 191 and 194 which are adjusted to provide the desired concrete mix and slump for a particular mix. When at operating speed, pump 154 delivers hydraulic fluid to relief valve 156 at about 2200 psi. This valve assures that the hydraulic fluid delivered to flow control 162 has a pressure of about 1800 psi. The return from the control valve 162 has sufficiently high pressure to drive pump 52 and fluid motors 176 and 180 as required during operation of the mixer.

Prior to start up of mixing, the operator presets the control valves in accordance with the requirements of the mix. The setting of valve 162 is checked to assure that the valve handle is properly positioned relative to a scale on the valve for proper supply of high pressure hydraulic fluid to the master lever valve 164. The setting of control valve 168 is manually adjusted to deliver hydraulic fluid of appropriate pressure to pump 52 to drive the pump and assure that a proper volume of water is delivered to the discharge chamber so that the concrete has proper slump characteristics. Valve 186 is appropriately adjusted to assure that the fluid motor 26 rotates at a speed for delivery of the sand and aggregate mix to the discharge chamber at an appropriate rate for the desired concrete mix.

Valve 191 is adjusted so that the hydraulic fluid supplied to the cement auger motor 86 rotates the motor to assure that cement is delivered to the discharge chamber at an appropriate rate as required by the desire concrete mix. Finally, valve 194 is adjusted to assure that the mixing auger fluid motor 42 rotates the auger 40 at an appropriate mixing speed for the concrete.

Following preliminary adjustments of the various control valves, the operator actuates accelerator 198 to bring the truck engine up to operating speed so that pump 154 delivers high pressure fluid to the hydraulic system 142. The lever control valves are all off. The operator then visually checks the proper settings of flow controls 162 and 168 using gauges 166 and 182. With main lever valve 164 closed, valve 54 is closed to assure water does not flow to the discharge chamber in the event lever valve 170 is shifted.

The operator then uses lever valve 178 to lower the chute and auger 38 and 40 from the upright travel position to an appropriate work position. Extension chute 44 is rigged as required. Valve 174 is actuated to swing the chute relative to the mixer for proper delivery of concrete. The operator then zeroes the card meter 141 and inserts and locks a ticket within the meter.

The levers of valves 170, 190, 192 and 196 are shifted to the on positions. Main valve 164 is then shifted to supply fluid to valves 190, 192 and 196. The operator closes override switch 59 to prevent shifting of valve 164 from opening valve 54 and allowing pump 52 to flow water to the mixing chute. Override switch 59 is kept closed until the first sand and aggregate mix and cement are delivered to the discharge chamber and trough. The operator then deactivates the override switch 59 permitting delivery of water to the ingredients as they are mixed in the trough 38.

Mixing and delivery of concrete from the trough continue until card meter 141 indicates the required number of cubic yards of concrete have been supplied. At that time, the operator stops the ingredient and water supply by shifting levers 170, 190 and 192. Auger 40 continues to rotate to deliver all mixed concrete. At the end of the mix, after all concrete has been delivered from the trough, the operator may supply flush water to the discharge chamber and trough by shifting lever 170. The card meter is actuated to mark the ticket with the number of yards of concrete supplied.

During the mixing run, the operator checks the settings of the flow control valves using gauges 166, 182 and 188, tachometers 104 and 120 and visual inspection of the concrete as mixed in the chute. Adjustments may be made as required in order to assure the concrete meets customer specifications and is properly mixed. The continuously adjustable nature of the flow controls provides the opertor ample adjustment capability to meet customer requirements. In case of emergency the entire mixing operation is shut down by shifting the single lever of main valve 164.

When mixer 10 is used during cold weather and concrete curing may be adversely affected by low ambient temperatures, valve 136 is shifted to direct the engine exhaust gases through loop 130 within the tank 14 before mixing, typically during the drive to the work site. In this way, the water in the tank is preheated so that the concrete is likewise heated to aid in the curing process. It is desirable to cure concrete before the water in the mix freezes. Tank 14 and loop 130 are preferably formed from stainless steel for long term reliability.

If desired, an alarm system may be provided which senses the temperature of the water in the tank and actuates an alarm when the temperature exceeds a safe level. The alarm system may also include a device for automatically shifting valve 136 to flow exhaust gases directly out through pipe 124 and prevent further heating of the water in the tank 14.

While I have illustrated and described a preferred embodiment of my invention, it is understood that this is capable of modification, and I therefore do not wish to be limited to the precise details set forth, but desire to avail myself of such changes and alterations as fall within the purview of the following claims.

What I claim my invention is:

1. A cement mobile mixer including a sand and aggregate hopper; a discharge chamber at one end of the hopper; a belt running along the bottom of the hopper with the downstream end of the belt extending into the chamber for delivery of sand and aggregate to the chamber; concrete mixing means below the chamber; a cement hopper above the chamber; cement delivery means in the bottom of the cement hopper for delivery of cement into the chamber; a water tank, a water pipe extending between the tank and chamber; a water pump for flowing water from the tank through the pipe and into the chamber whereby sand and aggregate, cement and water delivered to the chamber fall into the mixing means; a hydraulic system having a first variable speed hydraulic drive means for moving the belt downstream to deliver sand and aggregate to the chamber at an adjustable rate; a second variable speed hydraulic drive means for operating the cement delivery means to deliver cement to the chamber at an adjustable rate; a third variable speed hydraulic drive means for operating the water pump to deliver water to the chamber at an adjustable rate, a source of high pressure hydraulic fluid, a first adjustable valve connected between the source and the first hydraulic drive means, a second adjustable valve connected between the source and the second hydraulic drive means, a third adjustable valve connected between the source and the third hydraulic drive means whereby said valves may be independently adjusted so that the belt, cement delivery supply means and pump deliver sand and aggregate mix, cement and water to the chamber at rates dependent upon the requirements of a given concrete mix; first detector means for generating a first signal proportional to the rate of delivery of sand and aggregate to the chamber by the belt; second detector means for generating a second signal proportional to the rate of delivery of cement to the chamber by the cement delivery means; and first and second detectors mounted on the mixer in positions to be observed by the operator and responsive respectively to the first and second signals so that an operator may observe the detectors and the mixed concrete and adjust said valves during operation of the mixer to maintain the proper concrete mix.

2. A cement mobile mixer as in claim 1 wherein the mixing means includes a trough beneath the chamber and a mixing auger within the trough; a fourth variable speed hydraulic drive means for rotating the auger in the trough and a fourth adjustable valve connected between the source and the fourth hydraulic drive means whereby the operator may continuously adjust the speed at which the auger mixes the sand and aggregate mix, cement and water to make concrete.

3. A cement mobile mixer as in claim 1 wherein the hopper includes an inwardly sloping sidewall and a cabinet on the side of the mixer beneath the inwardly sloping sidewall wherein the control valves are located within said cabinet.

4. A cement mobile mixer as in claim 3 wherein the hydraulic control system includes at least one lever actuated on-off valve connected between the source and at least one said drive means and levers for such on-off valves located outside of said cabinet at a control station adjacent the mixing chamber; and cable connection means joining said levers and on-off valves whereby an operator at the control station may control the flow of hydraulic fluid to the drive means by moving the levers while at the control station.

5. A cement mobile mixer as in claim 4 wherein said on-off valves include a main valve and lever operable to control flow of hydraulic fluid to both of said first and second drive means.

6. A cement mobile mixer as in claim 5 wherein said pipe includes a pressure relief valve located downstream of the pump, a return pipe running from the relief valve to the tank and a control valve in the pipe downstream of the relief valve and further including control valve means operable upon shutoff of the main valve to close said first pipe and prevent the pump from flowing water to the chamber.

7. A cement mobile mixer as in claim 5 wherein said connections between the pressure fluid source and the drive means include at least one pressure gauge for visually indicating the pressure of hydraulic fluids delivered to at least one drive means.

8. A cement mobile mixer including a sand and aggregate hopper; a discharge chamber at one end of the hopper; a belt running along the bottom of the hopper with the downstream end of the belt extending into the chamber for delivery of sand and aggregate to the chamber; concrete mixing means below the chamber; a cement hopper above the chamber; cement delivery means in the bottom of the cement hopper for delivery of cement into the chamber; a water tank, a water pipe extending between the tank and chamber; a water pump for flowing water from the tank through the pipe and into the chamber whereby sand and aggregate, cement and water delivered to the chamber fall into the mixing means; water control means for operating the water pump to deliver water to the chamber; a hydraulic system having a first variable speed hydraulic drive means for moving the belt downstream to deliver sand and aggregate to the chamber at an adjustable rate; a second variable speed hydraulic drive means for operating the cement delivery means to deliver cement to the chamber at an adjustable rate; a source of high pressure hydraulic fluid, a first adjustable valve connected between the source and the first hydraulic drive means, a second adjustable valve connected between the source and the second hydraulic drive means whereby said valves may be independently adjusted so that the belt and cement delivery supply means deliver sand and aggregate mix and cement to the chamber at rates dependent upon the requirements of a given concrete mix; first detector means for generating a first signal proportional to the rate of delivery of sand and aggregate to the chamber by the belt; second detector means for generating a second signal proportional to the rate of delivery of cement to the chamber by the cement delivery means; and first and second detectors mounted on the mixer in positions to be observed by the operator and responsive respectively to the first and second signals so that an operator may observe the detectors and the mixed concrete and adjust said valves during operation of the mixer to maintain the proper concrete mix.

9. A cement mobile mixer as in claim 8 wherein the mixing means includes a trough beneath the chamber and a mixing auger within the trough; a third variable speed hydraulic drive means for rotating the auger in the trough and a third adjustable valve connected between the source and the third hydraulic drive means whereby the operator may continuously adjust the speed at which the auger mixes the sand and aggregate mix and cement to make concrete.

10. A cement mobile mixer as in claim 8 wherein the hopper includes an inwardly sloping sidewall and a cabinet on the side of the mixer beneath the inwardly sloping sidewall and wherein the control valves are located within said cabinet.

* * * * *